US006935853B2

(12) United States Patent
Lee et al.

(10) Patent No.: US 6,935,853 B2
(45) Date of Patent: Aug. 30, 2005

(54) VARIABLE CAPACITY ROTARY COMPRESSOR

(75) Inventors: Moon Joo Lee, Suwon (KR); Seung Kap Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/811,951

(22) Filed: Mar. 30, 2004

(65) Prior Publication Data

US 2005/0019189 A1 Jan. 27, 2005

(30) Foreign Application Priority Data

Jul. 23, 2003 (KR) ..... 10-2003-0050688

(51) Int. Cl.[7] ..... F03C 2/00; F04C 23/00

(52) U.S. Cl. ..... 418/60; 418/69; 417/218; 417/221; 417/287; 417/298; 417/410.3

(58) Field of Search ..... 418/60, 69, 29, 418/57; 417/218, 221, 287, 298, 410.3, 326

(56) References Cited

U.S. PATENT DOCUMENTS 1,789,842 A * 1/1931 Rolaff ..... 418/63
5,152,156 A * 10/1992 Tokairin ..... 418/60
5,871,342 A 2/1999 Harte et al.

FOREIGN PATENT DOCUMENTS

JP 59063393 A * 4/1984 ..... F04C/23/00
JP 61272492 A * 12/1986 ..... F04C/23/00
JP 62070686 A * 4/1987 ..... F04C/23/00
JP 04187892 A * 7/1992 ..... F04C/23/00

* cited by examiner

*Primary Examiner*—Theresa Trieu
(74) *Attorney, Agent, or Firm*—Staas & Halsey LLP

(57) ABSTRACT

A variable capacity rotary compressor, which is designed to make an internal pressure of a compression chamber, where an idle rotation is executed, be equal to an outlet side pressure of the rotary compressor, thus minimizing a rotating resistance. The compressor includes a housing partitioned into two compression chambers having different capacities by a partition plate. A rotating shaft rotates in the compression chambers. Two eccentric units are mounted to the rotating shaft to be placed in the compression chambers, and execute a compression rotation and an idle rotation according to a rotating direction of the rotating shaft. A pressure control unit functions to apply the pressure of the outlet side of the compressor to the compression chamber which executes the idle rotation. The pressure control unit includes a path control channel which is vertically provided through the partition plate to be placed at a position outside the compression chambers. Two valve seats are seated in opposite ends of the path control channel. A valve member is movably set in the path control channel. A communicating path is provided through the partition plate to make the outlet side communicate with the path control channel. Two inlet channels are provided at predetermined positions of the housing to make the path control channel communicate with the compression chambers.

23 Claims, 9 Drawing Sheets

VARIABLE CAPACITY ROTARY COMPRESSOR

CROSS-REFERENCE TO RELATED APPLICATIONS

This application claims the benefit of Korean Application No. 2003-50688, filed Jul. 23, 2003, in the Korean Intellectual Property Office, the disclosure of which is incorporated herein by reference.

BACKGROUND OF THE INVENTION

1. Field of the Invention

The present invention relates, in general, to variable capacity rotary compressors and, more particularly, to a variable capacity rotary compressor having a pressure control unit which makes a pressure in a hermetic casing be equal to a pressure in a compression chamber where an idle rotation is executed.

2. Description of the Related Art

Recently, a variable capacity compressor has been increasingly used in refrigeration systems, such as air conditioners or refrigerators, to vary cooling capacity as desired, thus accomplishing an optimum cooling operation and saving energy.

An earlier patent disclosure dealing with a variable capacity compressor is found in U.S. Pat. No. 4,397,618. According to the patent, a rotary compressor is designed to vary a compression capacity thereof by holding or releasing a vane. The rotary compressor includes a casing in which a cylindrical compression chamber is provided. A rolling piston is installed in the compression chamber of the casing to be eccentrically rotated. Further, a vane, designated as a "slide" in U.S. Pat. No. 4,397,618, is installed in the casing, and reciprocates in a radial direction while being in contact with an outer surface of the rolling piston. A vane holding unit, which includes a ratchet bolt, an armature, and a solenoid, is provided at a side of the vane to hold or release the vane, thus varying the compression capacity of the rotary compressor. That is, the vane is held or released in response to a reciprocating movement of the ratchet bolt controlled by the solenoid, thus varying the compression capacity of the rotary compressor.

However, the conventional variable capacity rotary compressor has a problem in that it is designed such that the compression operation thereof is controlled by holding or releasing the vane for a predetermined period of time, so it is difficult to precisely vary the compression capacity to obtain a desired exhaust pressure.

Further, the conventional variable capacity rotary compressor has another problem in that the ratchet bolt holding the vane is designed to enter a side of the vane and be locked to a locking hole formed at the vane, so it is not easy to hold the vane which reciprocates at a high speed when the compressor is operated, thus having poor reliability.

SUMMARY OF THE INVENTION

Accordingly, it is an aspect of the present invention to provide a variable capacity rotary compressor, which is designed to precisely vary a compression capacity to obtain a desired exhaust pressure, and to easily control an operation of varying the compression capacity.

It is another aspect of the present invention to provide a variable capacity rotary compressor, which is designed to make an internal pressure of a compression chamber, where an idle rotation is executed, be equal to an internal pressure of a hermetic casing, thus preventing a vane from compressing a roller, in addition to preventing inflow of oil, therefore minimizing a rotating resistance.

Additional aspects and/or advantages of the invention will be set forth in part in the description which follows and, in part, will be obvious from the description, or may be learned by practice of the invention.

The above and/or other aspects are achieved by providing a variable capacity rotary compressor, including a housing, a rotating shaft, first and second eccentric units, first and second rollers, first and second vanes, and a pressure control unit. The housing is installed in a hermetic casing, and is partitioned into first and second compression chambers having different capacities by a partition plate. The rotating shaft rotates in the first and second compression chambers. The first and second eccentric units are mounted to the rotating shaft to be placed in the first and second compression chambers, respectively. In this case, one of the first and second eccentric units is eccentric from the rotating shaft to execute a compression rotation while a remaining one of the first and second eccentric units is released from eccentricity from the rotating shaft to execute an idle rotation, according to a rotating direction of the rotating shaft. The first and second eccentric units are oppositely operated. The first and second rollers are fitted over the first and second eccentric bushes, respectively. The first and second vanes are installed in the first and second compression chambers, respectively, to be reciprocated in a radial direction of the rotating shaft while being in contact with the first and second rollers, respectively. The pressure control unit functions to apply a pressure of an outlet side of the compressor to one of the first and second compression chambers which executes the idle rotation. The pressure control unit includes a path control channel, first and second valve seats, a valve member, a communicating path, and first and second inlet channels. The path control channel is vertically provided through the partition plate to be placed at a position outside the first and second compression chambers. The first and second valve seats are seated in opposite ends of the path control channel, and each has a central hole. The valve member is movably set in the path control channel to close the central hole of the first and second valve seats which are adjacent to the compression chamber where the compression operation is executed. The communicating path is provided through the partition plate to make an interior of the hermetic casing communicate with the path control channel. The first and second inlet channels are provided at predetermined positions of the housing. In this case, the first inlet channel makes the central hole of the first valve seat communicate with the first compression chamber, while the second inlet channel makes the central hole of the second valve seat communicate with the second compression chamber.

According to an aspect of the invention, the housing includes a first housing part to define the first compression chamber therein, and a second housing part to define the second compression chamber therein. The first and second housing parts are mounted to opposite surfaces of the partition plate, respectively, with the first and second inlet channels being provided on surfaces of the first and second housing parts which are in contact with the partition plate, to have a predetermined depth.

According to an aspect of the invention, the first and second valve seats are supported by the first and second housing parts to be prevented from being removed from the path control channel.

According to an aspect of the invention, outlets of the first and second inlet channels are placed at positions opposite to first and second vanes.

According to an aspect of the invention, an elastic thin plate is used as the valve member.

According to an aspect of the invention, the first and second eccentric units include first and second eccentric cams mounted to an outer surface of the rotating shaft to be placed in the first and second compression chambers, respectively, first and second eccentric bushes rotatably fitted over the first and second eccentric cams, respectively, and first and second rollers fitted over the first and second eccentric bushes, respectively. The first and second eccentric units also include a locking unit to make one of the first and second eccentric bushes be eccentric from the rotating shaft while making a remaining one of the first and second eccentric bushes be released from eccentricity from the rotating shaft, according to a rotating direction of the rotating shaft. In this case, the first and second eccentric bushes are eccentric in opposite directions.

According to an aspect of the invention, the rotary compressor also includes a cylindrical connecting part to connect the first and second eccentric bushes to each other while the first and second eccentric bushes are eccentric in the opposite directions. The locking unit includes a locking slot provided around the connecting part, and a locking pin mounted to the rotating shaft to engage with the locking slot.

BRIEF DESCRIPTION OF THE DRAWINGS

The above and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
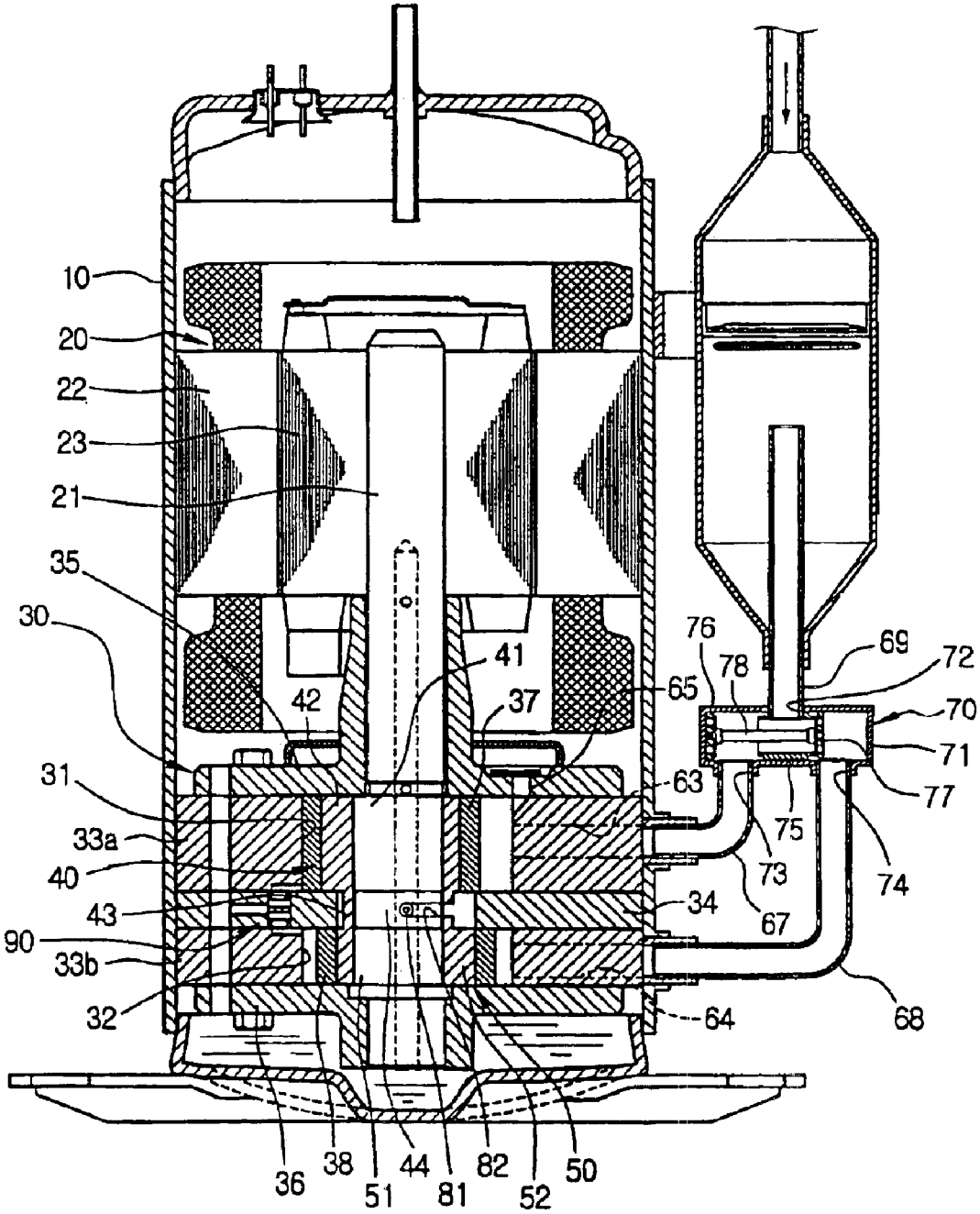
FIG. 1 is a sectional view illustrating a variable capacity rotary compressor, according to an embodiment of the present invention.

Reference will now be made in detail to the present preferred embodiments of the present invention, examples of which are illustrated in the accompanying drawings, wherein like reference numerals refer to like elements throughout.

As illustrated in FIG. 1, a variable capacity rotary compressor according to the present invention includes a hermetic casing 10. A drive unit 20 is installed in the casing 10 to be placed on an upper portion of the casing 10, and to generate a rotating force. A compressing unit 30 is installed in the casing 10 to be placed on a lower portion of the casing 10, and is connected to the drive unit 20 through a rotating shaft 21. The drive unit 20 includes a cylindrical stator 22, and a rotor 23. The stator 22 is mounted to an inner surface of the casing 10. The rotor 23 is rotatably and concentrically set in the stator 22, and is mounted to the rotating shaft 21 which is placed at a center of the casing 10. The drive unit 20 rotates the rotating shaft 21 forwards or backwards.

The compressing unit 30 includes a housing to define first and second compression chambers 31 and 32. The first compression chamber 31 is placed at an upper portion of the housing, and the second compression chamber 32 is placed at a lower portion of the housing. The first and second compression chambers 31 and 32 are both cylindrical, but have different capacities. The housing includes a first housing part 33*a* to define the first compression chamber 31 therein, and a second housing part 33*b* defining the second compression chamber 32 therein. Further, an upper flange 35 is mounted to an upper surface of the first housing part 33*a* to close an upper portion of the first compression chamber 31, and a lower flange 36 is mounted to a lower surface of the second housing part 33*b* to close a lower portion of the second compression chamber 32. The upper and lower flanges 35 and 36 function to rotatably support the rotating shaft 21. A partition plate 34 is interposed between the first and second housing parts 33*a* and 33*b* to be partitioned into the first and second compression chambers 31 and 32.

As illustrated in FIGS. 1 through 4, first and second eccentric units 40 and 50 are mounted to the rotating shaft 21 to be placed in the first and second compression chambers 31 and 32, respectively. First and second rollers 37 and 38 are rotatably fitted over the first and second eccentric units 40 and 50, respectively. Further, a first vane 61 is installed between an inlet port 63 and an outlet port 65 of the first compression chamber 31, and reciprocates in a radial direction while being in contact with an outer surface of the first roller 37, thus performing a compression operation. A second vane 62 is installed between an inlet port 64 and an outlet port 66 of the second compression chamber 32, and reciprocates in a radial direction while being in contact with an outer surface of the second roller 38, thus performing a compression operation. The first and second vanes 61 and 62 are biased by vane springs 61*a* and 62*a*, respectively. Further, the inlet and outlet ports 63 and 65 of the first compression chamber 31 are arranged on opposite sides of the first vane 61. Similarly, the inlet and outlet ports 64 and 66 of the second compression chamber 32 are arranged on opposite sides of the second vane 62. Although not shown in the drawings in detail, the first and second outlet ports 65 and 66 communicate with an interior of the hermetic casing 10 through a path defined in the housing.

Figure 2:
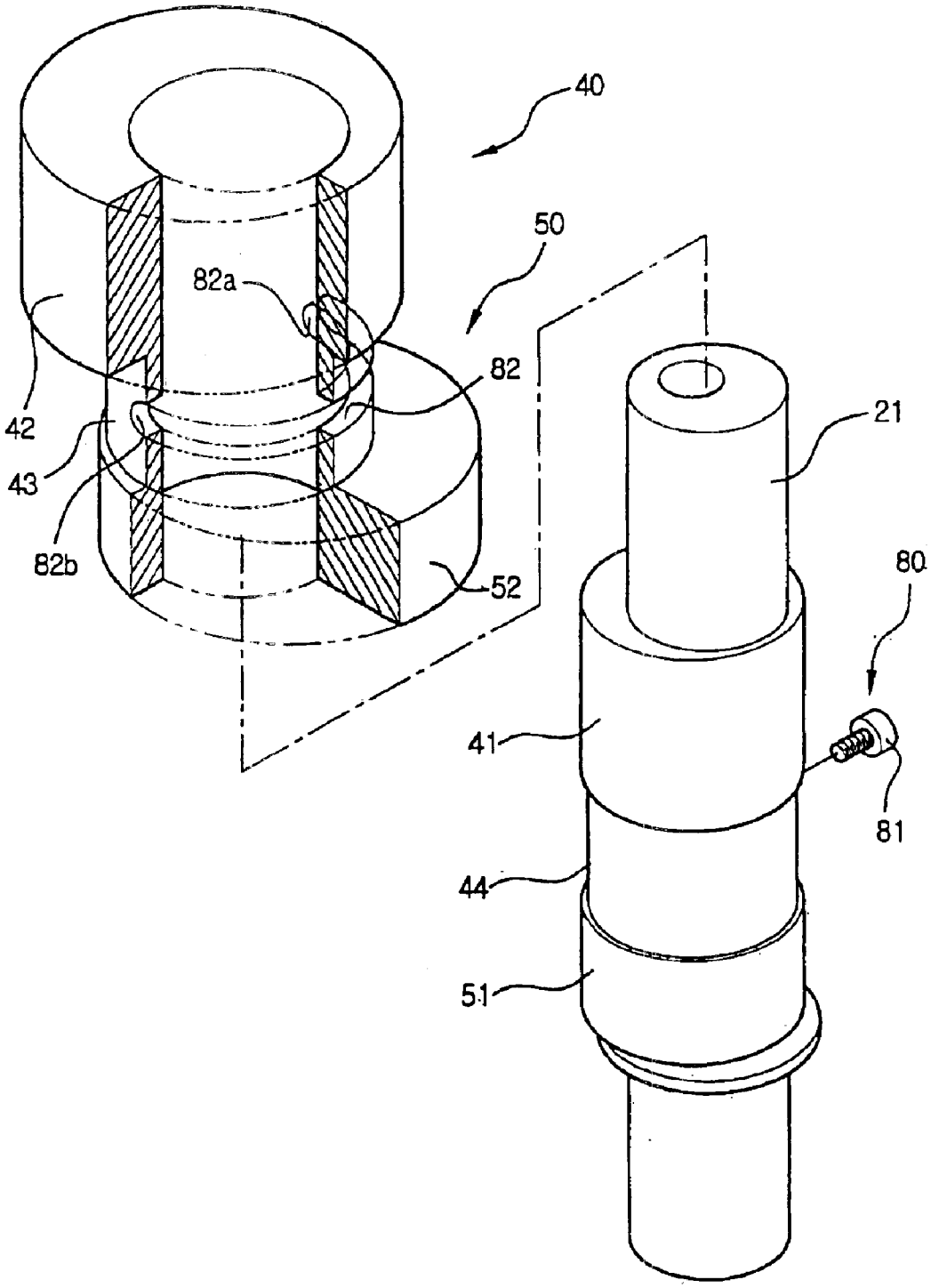
FIG. 2 is an exploded perspective view of an eccentric unit included in the variable capacity rotary compressor of FIG. 1.

The first and second eccentric units 40 and 50 include first and second eccentric cams 41 and 51, respectively. The first and second eccentric cams 41 and 51 are mounted to an outer surface of the rotating shaft 21 to be placed in the first and second compression chambers 31 and 32, respectively, while being eccentric from the rotating shaft 21 in a same direction. First and second eccentric bushes 42 and 52 are rotatably fitted over the first and second eccentric cams 41 and 51, respectively. As illustrated in FIG. 2, the first and second eccentric bushes 42 and 52 are integrally connected to each other by a cylindrical connecting part 43, and are eccentric from the rotating shaft 21 in opposite directions. Further, the first and second rollers 37 and 38 are rotatably fitted over the first and second eccentric bushes 42 and 52, respectively.

Figure 3:
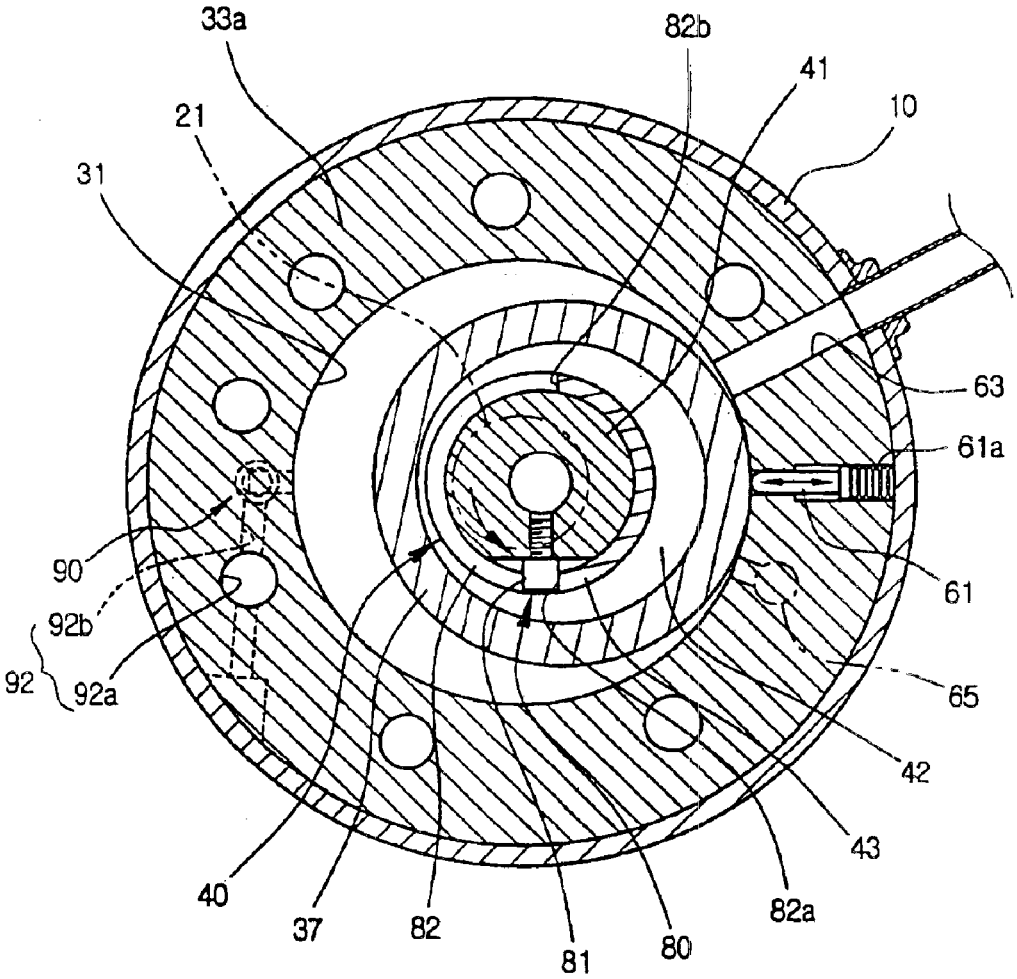
FIG. 3 is a sectional view illustrating a compression operation of a first compression chamber, when a rotating shaft of the variable capacity rotary compressor of FIG. 1 is rotated in a first direction.

As illustrated in FIGS. 2 and 3, an eccentric part 44 is mounted to the outer surface of the rotating shaft 21 between the first and second eccentric cams 41 and 51 to be eccentric from the rotating shaft 21 in a same direction of the eccentric cams 41 and 51. A locking unit 80 is mounted to the eccentric part 44. In this case, the locking unit 80 functions to make one of the first and second eccentric bushes 42 and 52 be eccentric from the rotating shaft 21 while making a remaining one of the first and second eccentric bushes 42 and 52 be released from eccentricity from the rotating shaft 21, according to a rotating direction of the rotating shaft 21. The locking unit 80 includes a locking pin 81 and a locking slot 82. The locking pin 81 is mounted to a flat surface of the eccentric part 44 in a screw-type fastening method to be projected from the flat surface of the eccentric part 44. The locking slot 82 is provided around a part of the connecting part 43 which connects the first and second eccentric bushes 42 and 52 to each other. The locking pin 81 engages with the locking slot 82 to make one of the first and second eccentric bushes 42 and 52 be eccentric from the rotating shaft 21 while a remaining one of the first and second eccentric bushes 42 and 52 is released from eccentricity from the rotating shaft 21, according to a rotating direction of the rotating shaft 21.

That is, when the rotating shaft 21 is rotated while the locking pin 81 mounted to the eccentric part 44 of the rotating shaft 21 engages with the locking slot 82 of the connecting part 43, the locking pin 81 is rotated within the locking slot 82 to be locked by either of locking parts 82*a* and 82*b* which are provided at opposite ends of the locking slot 82, thus making the first and second eccentric bushes 42 and 52 be rotated along with the rotating shaft 21. Further, when the locking pin 81 is locked by either of the locking parts 82*a* and 82*b* of the locking slot 82, one of the first and second eccentric bushes 42 and 52 is eccentric from the rotating shaft 21 and a remaining one of the first and second eccentric bushes 42 and 52 is released from eccentricity from the rotating shaft 21. Thus, a compression operation is executed in one of the first and second compression chambers 31 and 32, and an idle operation is executed in a remaining one of the first and second compression chambers 31 and 32. On the other hand, when the rotating direction of the rotating shaft 21 is changed, the first and second eccentric bushes 42 and 52 are arranged oppositely to the above-mentioned state.

As illustrated in FIG. 1, the variable capacity rotary compressor according to the present invention also includes a path control unit 70. The path control unit 70 controls a refrigerant intake path to make a refrigerant fed from a refrigerant inlet pipe 69 be drawn into the inlet port 63 of the first compression chamber 31 or the inlet port 64 of the second compression chamber 32 (that is, the inlet port of a compression chamber where the compression operation is executed).

The path control unit 70 includes a hollow cylindrical body 71, and a valve unit installed in the body 71. An inlet 72 is provided at a central portion of the body 71 to be connected to the refrigerant inlet pipe 69. First and second outlets 73 and 74 are provided on opposite sides of the body 71. Two pipes 67 and 68, which are connected to the inlet port 63 of the first compression chamber 31 and the inlet port 64 of the second compression chamber 32, respectively, are connected to the first and second outlets 73 and 74, respectively.

Further, the valve unit includes a valve seat 75, first and second valve members 76 and 77, and a connecting member 78. The valve seat 75 has a cylindrical shape, and is opened at both ends thereof. The first and second valve members 76 and 77 are installed on both sides in the body 71, and axially reciprocate in the body 71 to open or close both ends of the valve seat 75. The connecting member 78 connects the first and second valve members 76 and 77 to each other to allow the first and second valve members 76 and 77 to move together. In this case, the path control unit 70 is operated as follows.

When the compression operation is executed in either of the first and second compression chambers 31 and 32, the first and second valve members 76 and 77 set in the body 71 move in a direction toward one of the two outlets 73 and 74 having a lower pressure due to a difference in pressure between the two outlets 73 and 74, thus automatically changing the refrigerant intake path. That is, the refrigerant intake path is formed to draw the refrigerant into the inlet port of the compression chamber where the compression operation is executed.

Further, as illustrated in FIG. 1, the rotary compressor according to the present invention includes a pressure control unit 90. The pressure control unit 90 functions to apply a pressure of an outlet side of the compressor to one of the first and second compression chambers 31 and 32 where the idle rotation is executed, thus allowing an internal pressure of the one of the first and second compression chambers 31 and 32, where the idle rotation is executed, to be equal to an internal pressure of the hermetic casing 10.

Figure 7:
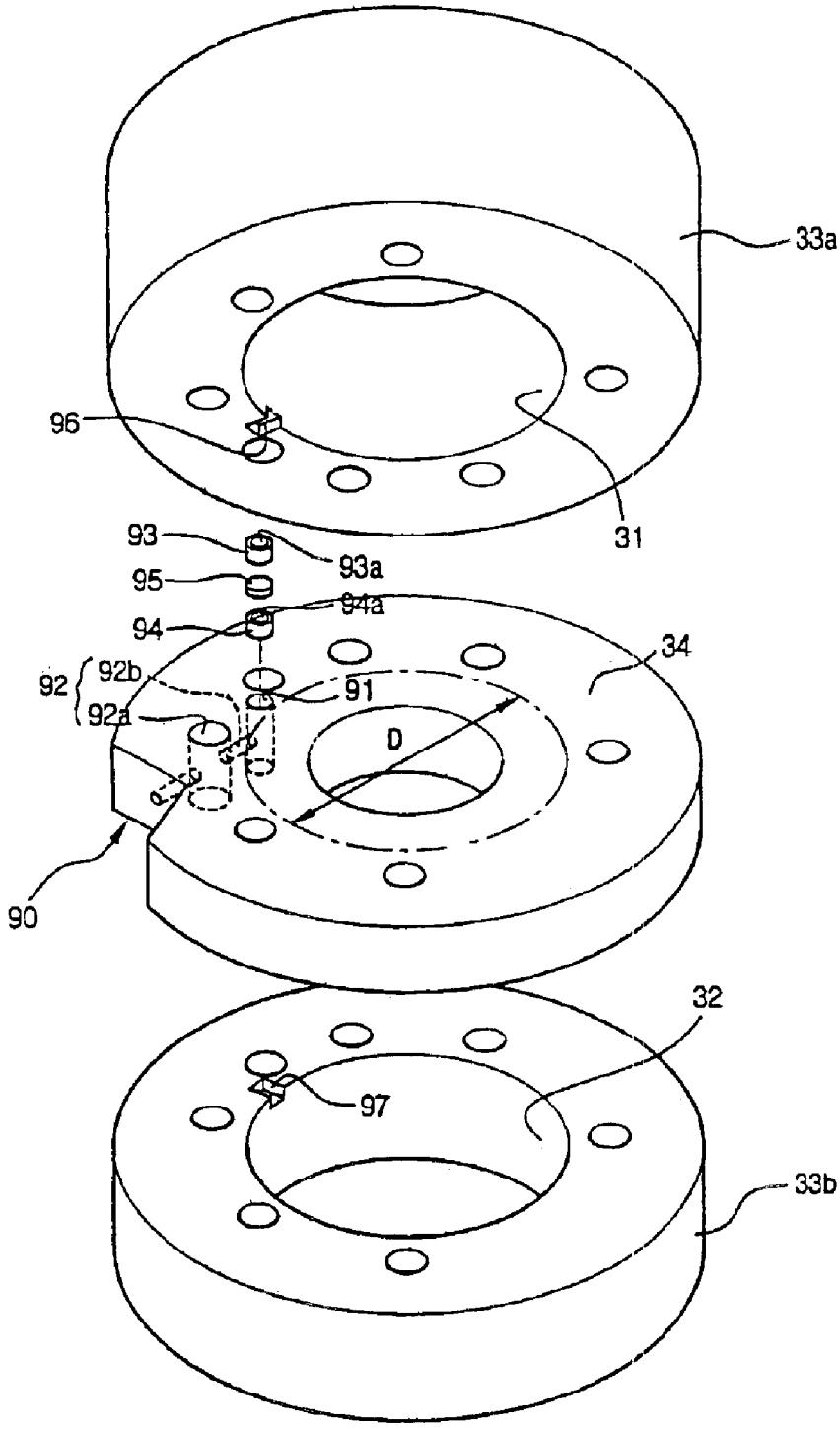
FIG. 7 is an exploded perspective view illustrating a pressure control unit of the variable capacity rotary compressor of FIG. 1.
Figure 8:
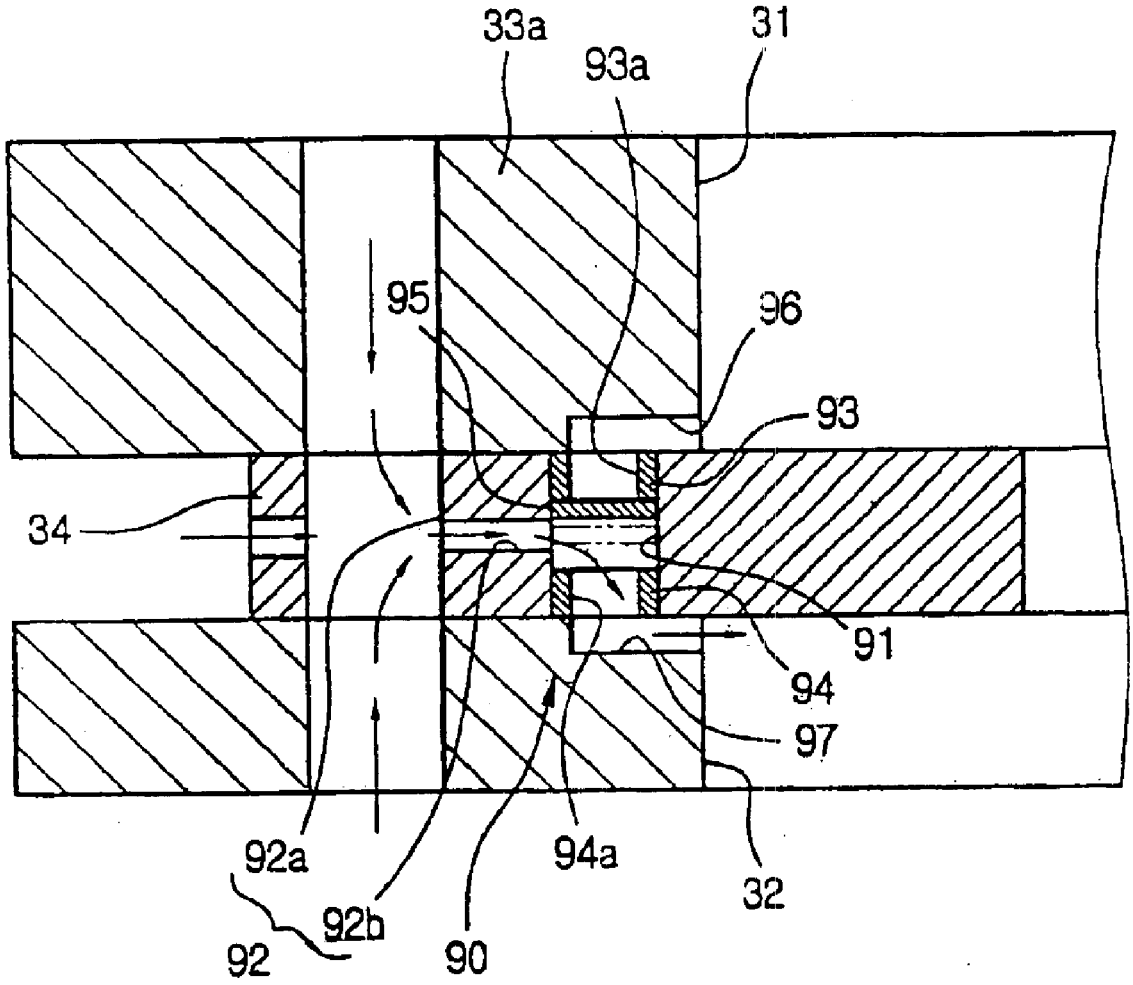
FIG. 8 is a sectional view of the pressure control unit of the variable capacity rotary compressor, when the idle rotation is executed in the second compression chamber.

The pressure control unit 90, as illustrated in FIGS. 7 and 8, includes a path control channel 91, and a communicating path 92. In this case, the path control channel 91 is provided through the partition plate 34 by which the first and second compression chambers 31 and 32 are partitioned into each other. The communicating path 92 is provided to allow the path control channel 91 to communicate with an interior of the hermetic casing 10. Further, the pressure control unit 90 includes first and second valve seats 93 and 94, and a valve member 95. The first and second valve seats 93 and 94 are installed in upper and lower portions of the path control channel 91, respectively. The valve member 95 is set in the path control channel 91 to be movable between the first and second valve seats 93 and 94.

The path control channel 91 is provided through the partition plate 34 to be placed at a position outside the first and second compression chambers 31 and 32 having an inner diameter D. Thus, when the first housing part 33*a* is mounted to an upper surface of the partition plate 34 and the second housing part 33*b* is mounted to a lower surface of the partition plate 34, openings provided at upper and lower portions of the path control channel 91 are covered with the first and second housing parts 33*a* and 33*b*. The first and second valve seats 93 and 94 are installed in upper and lower ends of the path control channel 91, respectively, in a press-fitting method. The first valve seat 93 has a central hole 93*a*, and the second valve seat 94 has a central hole 94*a*. The central holes 93*a* and 94*a* are opened or closed by the valve member 95. Further, a lower surface of the first housing part 33*a* mounted to the partition plate 34, is depressed by a predetermined depth to form a first inlet channel 96. Similarly, an upper surface of the second housing part 33*b* mounted to the partition plate 34, is depressed by a predetermined depth to form a second inlet channel 97. Thus, the central hole 93*a* of the first valve seat 93 communicates with the first compression chamber 31, while the central hole 94*a* of the second valve seat 94 communicates with the second compression chamber 32. According to the present invention, the first and second valve seats 93 and 94 are supported by the first and second housing parts 33*a* and 33*b* when the first and second housing parts 33*a* and 33*b* are mounted to the partition plate 34. Thus, although a high pressure is applied to an interior of the path control channel 91, the first and second valve seats 93 and 94 are not undesirably removed from the path control channel 91.

The valve member 95 includes a plate of a predetermined thickness, and is set in the path control channel 91 to be movable within a predetermined range. Thus, the valve member 95 moves toward the compression chamber 31, 32 where the compression operation is executed by a suction force of the compression chamber 31, 32 where the compression operation is executed, thus closing the central holes 93*a*, 94*a* of the first and second valve seats 93, 94 adjacent to the compression chamber 31, 32 where the compression operation is executed, while opening the central holes 93*a*, 94*a* of the first and second valve seats 93, 94 adjacent to the compression chamber 31, 32 where the idle rotation is executed. Preferably, outlets of the first and second inlet channels 96 and 97 provided at predetermined positions of the first and second housing parts 33*a* and 33*b*, respectively, are placed at a position which is angularly spaced apart from the first and second vanes 61 and 62 within an angular range of 140~220°. The outlets are placed at the position because a suction force is generated in the compression chamber 31, 32 where the compression operation is executed, to operate the valve member 95 smoothly. More preferably, the outlets of the first and second inlet channels 96 and 97 are placed at a position opposite to the first and second vanes 61 and 62, respectively.

The communicating path 92 functions to make the interior of the hermetic casing 10 communicate with the path control channel 91. Further, the communicating path 92 includes a first communicating part 92*a*, and a second communicating part 92*b*. The first communicating part 92*a* is provided through the partition plate 34 in a vertical direction thereof to make the first and second compression chambers 33*a* and 33*b* communicate with the partition plate 34. The second communicating part 92*b* is provided through the partition plate 34 in a horizontal direction thereof to make the first communicating part 92*a* communicate with the path control channel 91.

The operation of the variable capacity rotary compressor according to the present invention will be described below.

Figure 4:
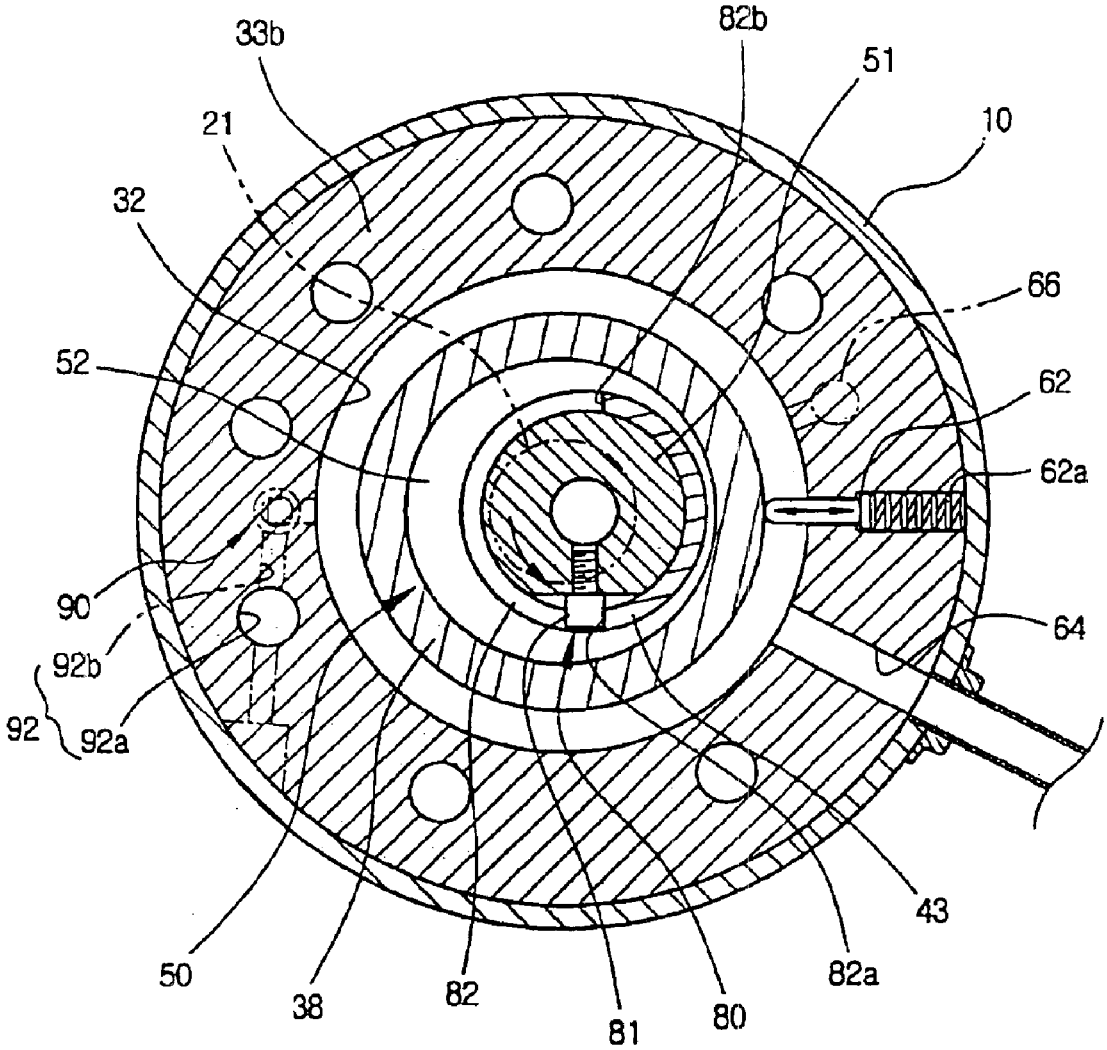
FIG. 4 is a sectional view illustrating an idle operation of a second compression chamber, when the rotating shaft of the variable capacity rotary compressor of FIG. 1 is rotated in the first direction.

As illustrated in FIG. 3, when the rotating shaft 21 is rotated in a direction, an outer surface of the first eccentric bush 42 in the first compression chamber 31 is eccentric from the rotating shaft 21 and the locking pin 81 is locked by the locking part 82*a* of the locking slot 82. Thus, the first roller 37 is rotated while coming into contact with an inner surface of the first compression chamber 31, thus executing the compression operation in the first compression chamber 31. At this time, the second eccentric bush 52 is arranged in the second compression chamber 32 as illustrated in FIG. 4. That is, an outer surface of the second eccentric bush 52, which is eccentric in a direction opposite to the first eccentric bush 42, is concentric with the rotating shaft 21, and the second roller 38 is spaced apart from an inner surface of the second compression chamber 32, thus an idle rotation is executed in the second compression chamber 32. Further, when the compression operation is executed in the first compression chamber 31, the refrigerant is drawn into the inlet port 63 of the first compression chamber 31. In this case, the path control unit 70 controls the refrigerant intake path to draw the refrigerant into the first compression chamber 31.

As such, when the compression operation is executed in the first compression chamber 31 and the idle rotation is executed in the second compression chamber 32, the valve member 95 set in the path control channel 91 moves upwards by a difference in pressure between the first and second compression chambers 31 and 32, thus closing the central hole 93*a* of the valve seat 93 which is adjacent to the first compression chamber 31, as illustrated in FIG. 8.

In a detailed description, while the first roller 37, which is placed in the first compression chamber 31 to be eccentric from the rotating shaft 21, is rotated from the first vane 61 to the first inlet channel 96, a pressure of the first inlet channel's side is increased. After the first roller 37 passes the first inlet channel 96, a suction force of the first inlet channel's side of the first compression chamber 31 acts on the valve member 95 to move the valve member 95 upwards, thus closing the central hole 93*a* of the first valve seat 93 which is adjacent to the first compression chamber 31. In this case, the central hole 94*a* of the second valve seat 94 which is adjacent to the second compression chamber 32 is opened to communicate with the interior of the hermetic casing 10 through the communicating path 92. At this time, the compressed refrigerant which is discharged through the outlet port of the first compression chamber 31 increases a pressure in the hermetic casing 10. The increased pressure is applied to the second compression chamber 32 through the communicating path 92 and the path control channel 91. Since there occurs a difference in pressure between the first and second compression chambers 31 and 32 after several rotations, the valve member 95 keeps closing the central hole 93*a* of the first valve seat 93 which is adjacent to the first compression chamber 31. Through such an operation, the internal pressure of the second compression chamber 32 where the idle rotation is executed is kept equal to the internal pressure of the hermetic casing 10, thus preventing the second vane 62 from compressing the second roller 38, and preventing oil from flowing into the second compression chamber 32. The above operation allows the rotating shaft 21 to be smoothly rotated.

Figure 5:
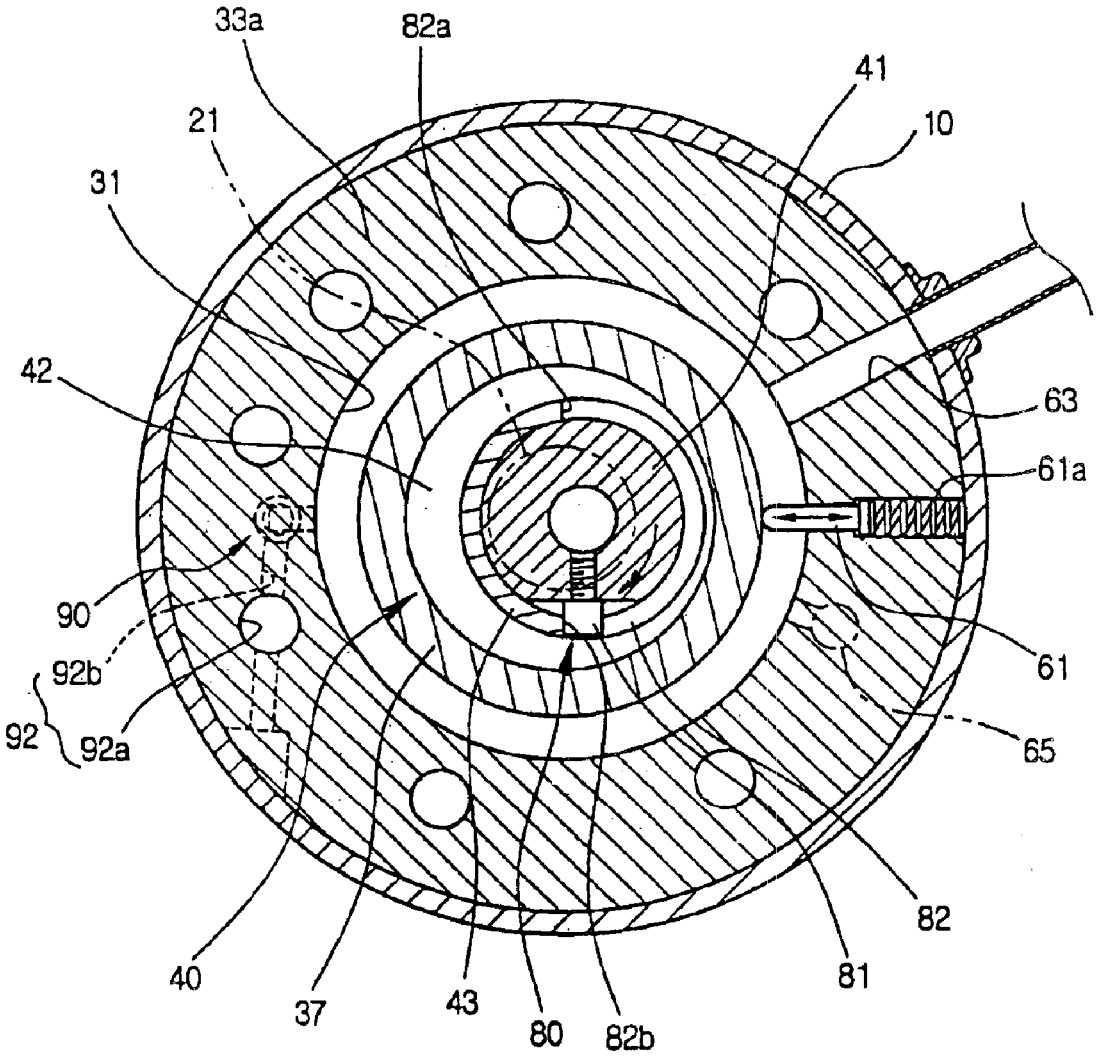
FIG. 5 is a sectional view illustrating an idle operation of the first compression chamber, when the rotating shaft of the variable capacity rotary compressor of FIG. 1 is rotated in a second direction.
Figure 6:
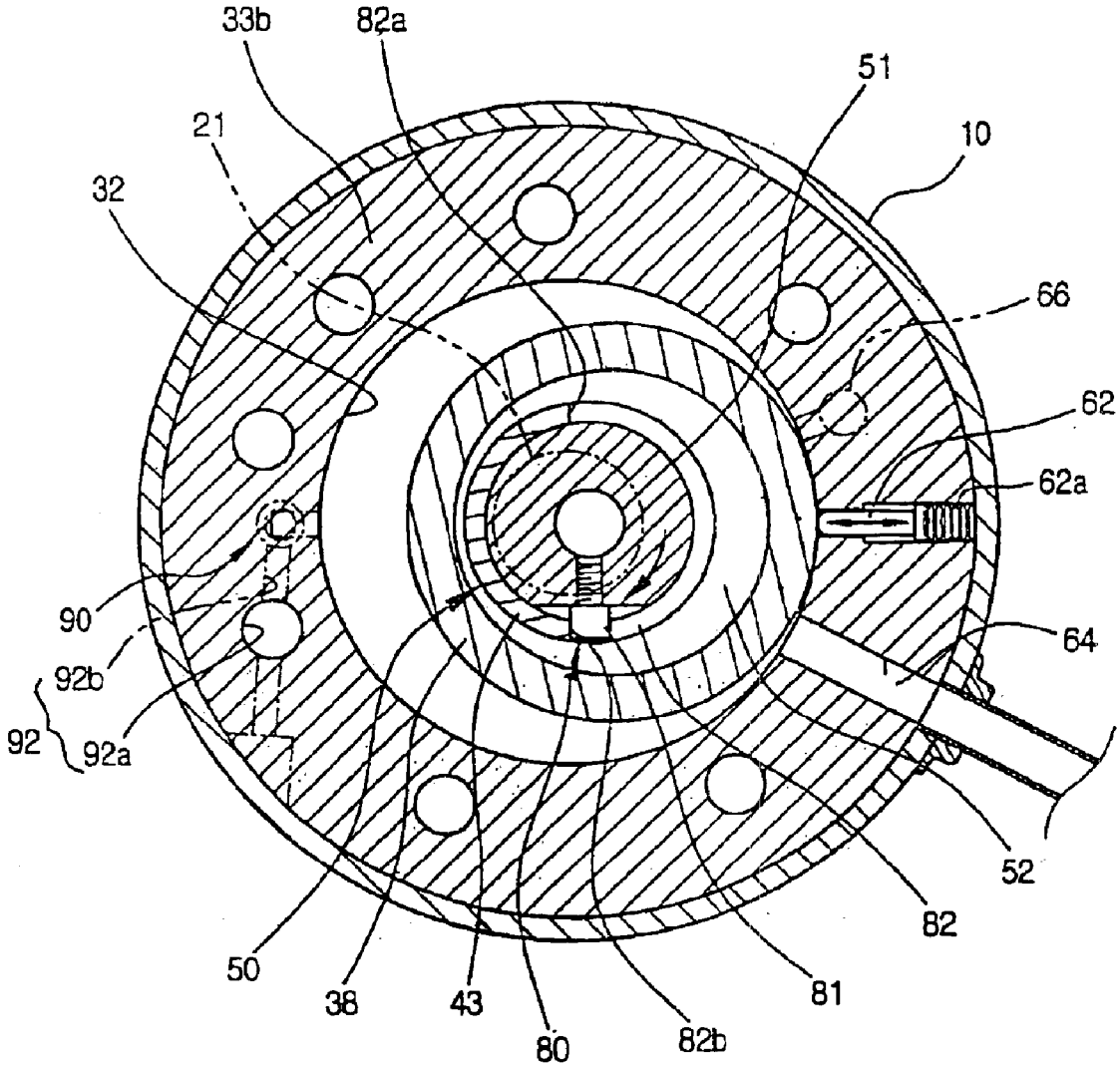
FIG. 6 is a sectional view illustrating a compression operation of the second compression chamber, when the rotating shaft of the variable capacity rotary compressor of FIG. 1 is rotated in the second direction.

When the rotating shaft 21 is rotated in a direction opposite to the direction of FIG. 3 to execute the compression operation, as illustrated in FIG. 5, the outer surface of the first eccentric bush 42 in the first compression chamber 31 is released from eccentricity from the rotating shaft 21 and the locking pin 81 engages with the locking part 82*b* of the locking slot 82. At this time, the first roller 37 is rotated while being spaced apart from the inner surface of the first compression chamber 31, thus the idle rotation is executed in the first compression chamber 31. Meanwhile, the outer surface of the second eccentric bush 52 in the second compression chamber 32 is eccentric from the rotating shaft 21, and the second roller 38 is rotated while being in contact with the inner surface of the second compression chamber 32, as illustrated in FIG. 6. At this time, the compression operation is executed in the second compression chamber 32.

Figure 9:
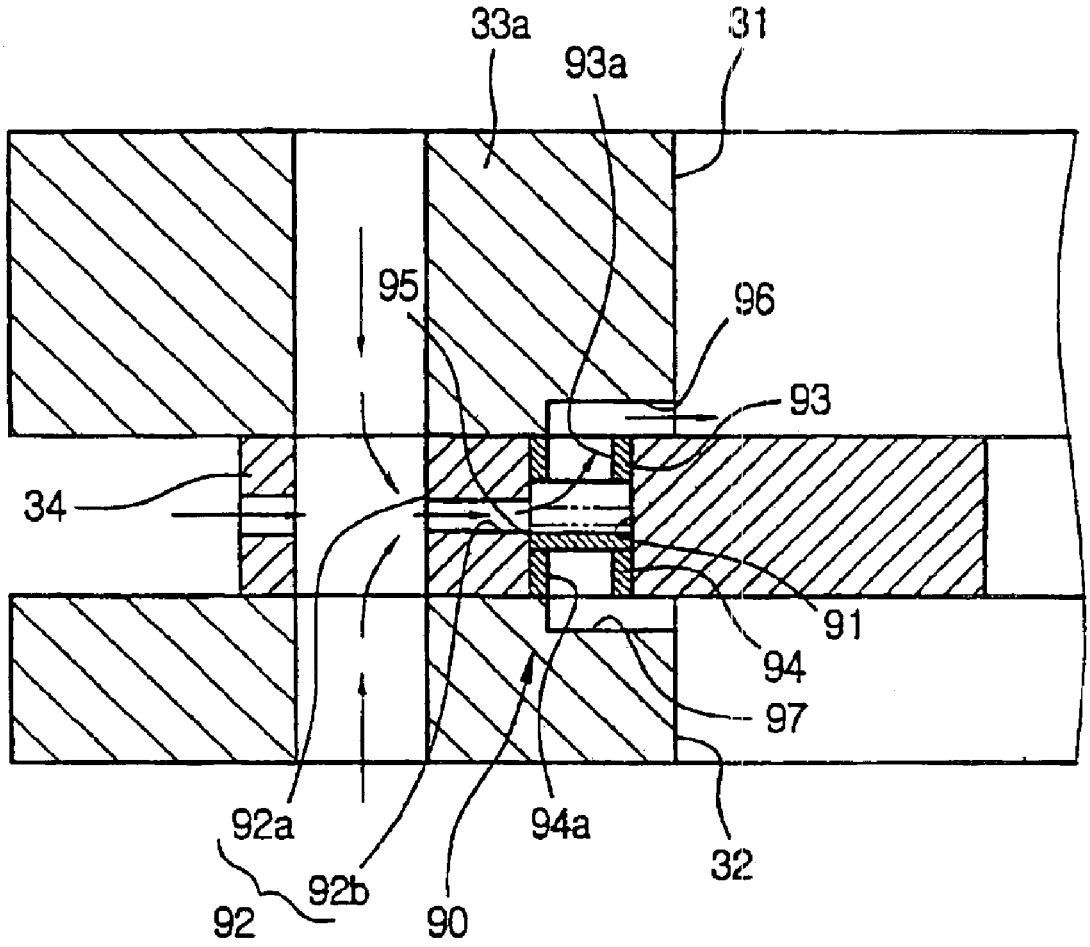
FIG. 9 is a sectional view of the pressure control unit of the variable capacity rotary compressor, when the idle rotation is executed in the first compression chamber.

When the compression operation is executed in the second compression chamber 32, the refrigerant is drawn into the inlet port 64 of the second compression chamber 32. Thus, the path control unit 70 controls the refrigerant intake path to draw the refrigerant into the second compression chamber 32. Further, when the compression operation is executed in the second compression chamber 32 and the idle rotation is executed in the first compression chamber 31, as illustrated in FIG. 9, the valve member 95 of the pressure control unit 90 moves toward the second compression chamber 32, thus closing the central hole 94*a* of the second valve seat 94 which is adjacent to the second compression chamber 32. In this case, the central hole 93*a* of the valve seat 93 which is adjacent to the first compression chamber 31 is opened to communicate with the communicating path 92. At this time, the internal pressure of the first compression chamber 31 is equal to the internal pressure of the hermetic casing 10, thus preventing the first vane 61 from compressing the first roller 37 which executes the idle rotation, and preventing oil from flowing into the first compression chamber 31, therefore allowing the rotating shaft 21 to be smoothly rotated.

As is apparent from the above description, the present invention provides a variable capacity rotary compressor, which is designed such that a compression operation is selectively performed in one of two compression chambers having different capacities, according to a rotating direction of a rotating shaft, thus precisely varying a compression capacity to obtain a desired exhaust pressure, and easily controlling the compression capacity of the rotary compressor.

Further, the present invention provides a variable capacity rotary compressor, which is operated to apply an internal pressure of a hermetic casing to a compression chamber where an idle rotation is executed, by a pressure control unit. Thus, an internal pressure of the compression chamber where the idle rotation is executed is allowed to be equal to the internal pressure of the hermetic casing, therefore preventing a vane installed in the compression chamber where the idle rotation is executed from compressing a roller and thereby preventing a rotating resistance from occurring. Thus, the compression capacity of the compressor is increased.

Further, the present invention provides a variable capacity rotary compressor, which is designed such that two valve seats of a pressure control unit are supported by first and second housing parts, thus preventing the valve seats from being undesirably removed from a path control channel although a high pressure acts on the path control channel.

Although an embodiment of the present invention has been shown and described, it would be appreciated by those skilled in the art that changes may be made in these embodiments without departing from the principles and spirit of the invention, the scope of which is defined in the claims and their equivalents.

What is claimed is:

1. A variable capacity rotary compressor, comprising:

a partition plate;

a housing installed in a hermetic casing, and partitioned into first and second compression chambers having different capacities by the partition plate;

a rotating shaft to rotate in the first and second compression chambers;

first and second eccentric units mounted to the rotating shaft to be placed in the first and second compression chambers, respectively, and to execute a compression rotation and an idle rotation according to a rotating direction of the rotating shaft, the first and second eccentric units being oppositely operated;

first and second vanes installed in the first and second compression chambers, respectively; and a pressure control unit to apply a pressure of an outlet side of the compressor to one of the first and second compression chambers which executes the idle rotation, the pressure control unit including:

a path control channel vertically provided through the partition plate to be placed at a position outside the first and second compression chambers;

a valve member movably set in the path control channel;

a communicating path to make an interior of the hermetic casing communicate with the path control channel; and first and second inlet channels provided at predetermined positions of the housing, with interiors of the first and second compression chambers communicating with the path control channel through the first and second inlet channels, respectively.

2. The rotary compressor according to claim 1, wherein the pressure control unit further comprises:

first and second valve seats, the first and second valve seats being seated in opposite ends of the path control channel and each having a central hole.

3. The rotary compressor according to claim 2, wherein the housing comprises:

a first housing part to define the first compression chamber therein; and a second housing part to define the second compression chamber therein, the first and second housing parts mounted to opposite surfaces of the partition plate, respectively, with the first and second inlet channels being provided on surfaces of the first and second housing parts which are in contact with the partition plate, respectively, to have a predetermined depth.

4. The rotary compressor according to claim 3, wherein the first and second valve seats are respectively supported by the first and second housing parts to be prevented from being removed from the path control channel.

5. The rotary compressor according to claim 4, wherein the central hole of the first valve seat and the central hole of the second valve seat are opened and closed by the valve member, and communicate with the first and second compression chambers, respectively.

6. The rotary compressor according to claim 3, wherein the partition plate is interposed between the first and second housing parts to be partitioned into the first and second compression chambers.

7. The rotary compressor according to claim 1, wherein outlets of the first and second inlet channels are placed positions which are an angularly spaced apart from the first and second vanes, respectively, within an angular range of 140~220°.

8. The rotary compressor according to claim 1, wherein the valve member has a shape of a flat plate.

9. The rotary compressor according to claim 1, wherein the first and second eccentric units comprise:

first and second eccentric cams mounted to an outer surface of the rotating shaft to be placed in the first and second compression chambers, respectively;

first and second eccentric bushes to rotatably fit over the first and second eccentric cams, respectively;

first and second rollers to rotatably fit over the first and second eccentric bushes, respectively; and a locking unit to make one of the first and second eccentric bushes be eccentric from the rotating shaft while making a remaining one of the first and second eccentric bushes be released from eccentricity from the rotating shaft, according to a rotating direction of the rotating shaft, the first and second eccentric bushes being eccentric in opposite directions.

10. The rotary compressor according to claim 9, further comprising:

a cylindrical connecting part to connect the first and second eccentric bushes to each other while the first and second eccentric bushes are eccentric in the opposite directions; and an eccentric part mounted to the outer surface of the rotating shaft between the first and second eccentric cams to be eccentric from the rotating shaft in a same direction of the first and second eccentric cams.

11. The rotary compressor according to claim 10 wherein the locking unit comprises:

a locking slot provided around the cylindrical connecting part; and a locking pin mounted to the eccentric part of the rotating shaft to engage with the locking slot.

12. The rotary compressor according to claim 11, wherein the locking pin is mounted to a flat surface of the eccentric part via a screw-type fastening to project from the flat surface of the eccentric part.

13. The rotary compressor according to claim 12, wherein the locking slot is provided around a part of the cylindrical connecting part which connects the first and second eccentric bushes to each other.

14. The rotary compressor according to claim 13, wherein the locking pin engages with the locking slot to make one of the first and second eccentric bushes be eccentric from the rotating shaft while a remaining one of the first and second eccentric bushes are released from eccentricity from the rotating shaft according to a rotating direction of the rotating shaft.

15. The rotary compressor according to claim 14, further comprising:

locking parts provided at opposite ends of the locking slot, wherein when the rotating shaft is rotated while the locking pin mounted to the eccentric part of the rotating shaft engages with the locking slot, the locking pin is rotated within the locking slot to be locked by at least one of the locking parts.

16. The rotary compressor according to claim 15, wherein when the locking pin is locked by at least one of the locking parts of the locking slot, one of the first and second eccentric bushes is eccentric from the rotating shaft and a remaining one of the first and second eccentric bushes is released from eccentricity from the rotating shaft, allowing a compression operation to be executed in one of the first and second compression chambers and an idle operation to be executed in a remaining one of the first and second compression chambers.

17. The rotary compressor according to claim 1 further comprising:

upper and lower flanges to rotatably support the rotating shaft.

18. The rotary compressor according to claim 1, further comprising:

a path control unit to control a refrigerant intake path to make a refrigerant fed from a refrigerant inlet pipe be drawn into an inlet port of the first compression chamber or an inlet port of the second compression chamber.

19. The rotary compressor according to claim 18, wherein the path control unit comprises:

a hollow cylindrical body;

a valve unit installed in the hollow cylindrical body;

an inlet provided at the body, to be connected to the refrigerant inlet pipe;

first and second outlets provided on opposite sides of the body; and two pipes connected to the inlet port of the first compression chamber and the inlet port of the second compression chamber, respectively, and connected to the first and second outlets, respectively.

20. The rotary compressor according to claim 19, wherein the valve unit comprises:

a valve seat having a cylindrical shape and opened at both ends thereof;

first and second valve members installed on both sides of the hollow cylindrical body, to axially reciprocate in the bow to open or close both ends of the valve seat; and a connecting member to connect the first and second valve member to each other, to allow the first and second valve members to move together.

21. The rotary compressor according to claim 20, wherein when a compression operation is executed in either of the first or second chambers, the first and second valve members set in the hollow cylindrical body move in a direction toward one of the first and second outlets having a lower pressure due to a difference in pressure between the first and second outlets automatically changing the refrigerant intake path.

22. A variable capacity rotary compressor, comprising:

a partition plate;

a housing partitioned into first and second compression chambers having different capacities by the partition plate;

a rotating shaft to rotate in the first and second compression chambers;

first and second eccentric units mounted to the rotating shaft to be placed in the first and second compression chambers, respectively, and to execute a compression rotation and an idle rotation according to a rotating direction of the rotating shaft, the first and second eccentric units being oppositely operated; and a pressure control unit to apply a pressure of an outlet side of the compressor to one of the first and second compression chambers which executes the idle rotation, the pressure control unit, including:

a path control channel vertically provided through the partition plate to be placed at a position outside the first and second compression chambers;

a valve member set in the path control channel;

a communicating path to make the path control channel communicate with the outlet side of the compressor; and first and second inlet channels to make the path control channel communicate with interiors of the first and second compression chambers.

23. A variable capacity rotary compressor including a housing installed in a hermetic casing and partitioned into first and second compression chambers having different capacities by a partition plate the compressor comprising:

a rotating shaft to rotate in the first and second compression chambers; and a pressure control unit to apply a pressure of an outlet side of the compressor to one of the first and second compression chambers which executes the idle rotation, allowing an internal pressure of the one of the first and second compression chambers which executes the idle rotation to be equal to an internal pressure of the hermetic casing.

* * * * *